US012768017B2

(12) United States Patent
Zhang et al.

(10) Patent No.: US 12,768,017 B2
(45) Date of Patent: Oct. 20, 2026

(54) NON-ORIENTED ELECTRICAL STEEL SHEET AND MANUFACTURING METHOD THEREFOR

(71) Applicant: BAOSHAN IRON & STEEL CO., LTD, Shanghai (CN)

(72) Inventors: Feng Zhang, Shanghai (CN); Shuangjie Chu, Shanghai (CN); Bo Wang, Shanghai (CN); Wenyue Zhang, Shanghai (CN); Kanyi Shen, Shanghai (CN); Guobao Li, Shanghai (CN)

(73) Assignee: BAOSHAN IRON & STEEL CO., LTD, Shanghai (CN)

( * ) Notice: Subject to any disclaimer, the term of this patent is extended or adjusted under 35 U.S.C. 154(b) by 821 days.

(21) Appl. No.: 17/634,918

(22) PCT Filed: Aug. 26, 2020

(86) PCT No.: PCT/CN2020/111404
§ 371 (c)(1),
(2) Date: Feb. 11, 2022

(87) PCT Pub. No.: WO2021/037063
PCT Pub. Date: Mar. 4, 2021

(65) Prior Publication Data

US 2022/0333226 A1 Oct. 20, 2022

(30) Foreign Application Priority Data

Aug. 26, 2019 (CN) ..... 201910790431.5

(51) Int. Cl.
*C22C 38/00* (2006.01)
*C21D 8/02* (2026.01)
(Continued)

(52) U.S. Cl.
CPC ..... *C22C 38/008* (2013.01); *C21D 8/02* (2013.01); *C21D 8/0226* (2013.01);
(Continued)

(58) Field of Classification Search
CPC ..... C22C 38/004
See application file for complete search history.

(56) References Cited

U.S. PATENT DOCUMENTS

2013/0263981 A1 10/2013 Zaizen et al.
2015/0013844 A1 1/2015 Xie et al.
(Continued)

FOREIGN PATENT DOCUMENTS

CA 3116571 A1 5/2020
CA 3122122 A1 7/2020
(Continued)

OTHER PUBLICATIONS

International Search Report for PCT/CN2020/111404 dated Oct. 24, 2020, issued from the China National Intellectual Property Administration.
(Continued)

*Primary Examiner* — Jophy S. Koshy
*Assistant Examiner* — Joshua S Carpenter
(74) *Attorney, Agent, or Firm* — Elizabeth L. Neal; DeWitt LLP

(57) ABSTRACT

Disclosed is a non-oriented electrical steel sheet with low magnetic anisotropy, which comprises the following chemical elements in mass percentage: 0<C≤0.005%; Si: 2.0-3.5%; Mn: 0.1-2.0%; at least one of Sn and Sb: 0.003-0.2%; Al: 0.2-1.8%; the balance being Fe and inevitable impurities. Further disclosed is a manufacturing method for the above non-oriented electrical steel sheet with low magnetic anisotropy, which includes the following steps: (1) smelting and casting; (2) hot rolling; (3) normalizing; (4) cold rolling;
(Continued)

(5) continuous annealing: rapidly heating a cold-rolled steel sheet from an initial temperature of 350° C.-750° C. to a soaking temperature at a heating rate of 50-800° C./s, and performing soaking and heat preservation; and (6) applying an insulating coating to obtain a finished non-oriented electrical steel sheet. The non-oriented electrical steel sheet is characterized by low iron loss and low magnetic anisotropy at high frequency.

7 Claims, 3 Drawing Sheets

(51) Int. Cl.

| | |
|---|---|
| ***C21D 8/0221*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 8/0236* (2013.01); *C21D 9/46* (2013.01); *C22C 38/002* (2013.01); *C22C 38/02* (2013.01); *C22C 38/04* (2013.01); *C22C 38/06* (2013.01)

(56) References Cited

U.S. PATENT DOCUMENTS

| | | | | |
|---|---|---|---|---|
| 2017/0044641 | A1 | 2/2017 | Fortunati | |
| 2019/0189318 | A1* | 6/2019 | Uesaka ..... | H01F 1/16 |
| 2019/0330710 | A1 | 10/2019 | Oda et al. | |
| 2020/0332388 | A1 | 10/2020 | Park et al. | |

FOREIGN PATENT DOCUMENTS

| | | | |
|---|---|---|---|
| CA | 3137623 | A1 | 12/2020 |
| CN | 1887512 | A | 1/2007 |
| CN | 100999050 | A | 7/2007 |
| CN | 101023195 | A | 8/2007 |
| CN | 102453837 | A | 5/2012 |
| CN | 102676916 | A | 9/2012 |
| CN | 103173678 | | 6/2013 |
| CN | 104789862 | | 7/2015 |
| CN | 106756475 | | 5/2017 |
| CN | 108474076 | A | 8/2018 |
| CN | 110106447 | A | 8/2019 |
| JP | 2004332031 | A | 11/2004 |
| JP | 2011256437 | A | 12/2011 |
| JP | 2019508574 | A | 3/2019 |
| KR | 20140133100 | A | 11/2014 |
| KR | 20160075262 | A | 6/2016 |
| KR | 101728827 | B1 | 4/2017 |
| KR | 10-20190077201 | A | 7/2019 |
| KR | 20190077984 | | 7/2019 |
| RU | 2092605 | C1 | 10/1997 |
| RU | 2534638 | C1 | 12/2014 |
| WO | 2017115657 | A1 | 7/2017 |
| WO | 2018135414 | A1 | 7/2018 |
| WO | 2019125078 | | 6/2019 |
| WO | 2019132130 | A1 | 6/2019 |

OTHER PUBLICATIONS

First Office Action in connection with the Chinese application No. 201910790431.5, dated Jun. 30, 2021.

First Search in connection with the Chinese application No. 201910790431.5, dated Jun. 23, 2021.

Office Action issued Dec. 13, 2022, in connection with corresponding Canadian Patent Application No. 3,149,832 from the Canadian Intellectual Property Office.

Office Action issued May 8, 2023, form the Japanese Patent Office in connection with corresponding JP Application No. 2022-511032.

Preliminary Office Action issued Jun. 1, 2023, form the Brazilian Patent Office in connection with corresponding BR Application No. BR112022003288-9.

First Examination Report issued May 11, 2022, form the Indian Patent Office in connection with IN Application No. 202217007023, National Phase of PCT/CN2020111404.

Search Report issued Jun. 9, 2022, form the Russian Patent Office in connection with RU Application No. 2022105057, National Phase of PCT/CN2020111404.

Search Report issued Jun. 22, 2022, form the European Patent Office in connection with EP Application No. 20858980.4, National Phase of PCT/CN2020111404.

First Office Action issued Oct. 5, 2022, form the Russian Patent Office in connection with RU Application No. 2022105057, National Phase of PCT/CN2020111404.

Liu Li et al., "Accumulation and Removal Technologies of Copper in the Steel Scrap Recycling Process," Jiangsu Metallurgy, vol. 31, No. 3, Aug. 2003.

Sun Changquan, "Research and Practice on Comprehensive Recovery of Copper and Cobalt from Iron Ore," Hunan Nonferrous Metals, 2010, No. 3.

Adamczyk, J., and A. Grajcar. "Effect of heat treatment conditions on the structure and mechanical properties of DP-type steel." Journal of Achievements in Materials and Manufacturing Engineering 17.1-2 (2006): 305.

* cited by examiner

NON-ORIENTED ELECTRICAL STEEL SHEET AND MANUFACTURING METHOD THEREFOR

CROSS-REFERENCE TO RELATED APPLICATIONS

The present application is the U.S. National Stage application of International Application No. PCT/CN2020/111404, filed Aug. 26, 2020, which International Application was published on Mar. 4, 2021, as International Publication No. WO2021/037063. The International Application claims priority to Chinese Patent Application No. 201910790431.5, filed Aug. 26, 2019, the contents of which are incorporated herein by reference in their entireties.

TECHNICAL FIELD

The present invention relates to a steel sheet and a manufacturing method therefor, in particular to a non-oriented electrical steel sheet and a manufacturing method therefor.

BACKGROUND

Due to an increasing demand for energy saving, environmental protection and high efficiency, the non-oriented electrical steel sheets for making driving motors of electric vehicles are gradually developing in the direction of thin gauge, high magnetic induction, low iron loss and high strength, so as to meet miniaturization and high efficiency of iron cores made therefrom. Usually, a large amount of silicon and aluminum will be added into the steel so as to meet the high-strength demands of steel sheets.

As an example, CN 103290190 A (published on Sep. 11, 2013, "Non-oriented Silicon Steel and Manufacturing Method Therefor") discloses a non-oriented silicon steel with excellent magnetic properties. In this disclosure, the content of Si reaches 2.5-4.0%, the content of Al reaches 0.5-1.5%. In this way, as the content of Si and Al increases, the iron loss of the material decreases rapidly, but the magnetic induction of the material also decreases rapidly.

As another example, in order to effectively improve the magnetic induction of finished strip steels, CN 1888112 A (published on Jan. 3, 2007, "High Grade Non-Oriented Electrical Steel with High Magnetic Induction and Manufacturing Method Therefor") discloses an electrical steel and a manufacturing method therefor. In this disclosure, an ideal hot-rolled strip steel structure is obtained by rough rolling with large reduction, rough roller rolling, high temperature coiling, and optimizing a reduction ratio of each pass. The increase in cold-rolling reduction ratio provides greater energy (deformation energy) for grain growth during the final recrystallization annealing process. Through measures such as obtaining an ideal grain structure by controlling a recrystallization annealing temperature, an iron core with excellent surface quality, high magnetic induction and low iron loss most suitable for a high-efficiency motor is obtained.

Researches have shown that a rapid continuous annealing of cold-rolled strip steel through electromagnetic induction heating can greatly increase the driving force for grain growth and reduce the formation of unfavorable textures, thereby greatly improving the electromagnetic properties of the finished steel strips.

As a further example, CN 102453837 A (published on May 16, 2012, "Manufacturing Method for Non-oriented Silicon Steel with High Magnetic Induction") discloses a manufacturing method for non-oriented silicon steel with high magnetic induction. In this disclosure, the method includes the following steps: 1) smelting and casting (wherein the non-oriented silicon steel comprises the following elements in weight percentage: Si: 0.1-1%, Al: 0.005-1%, C≤0.004%, Mn: 0.10-1.50%, P≤0.2%, S≤0.005%, N≤0.002%, Nb+V+Ti≤0.006%; the balance being Fe), which includes steel making, secondary refining, and casting into a casting slab; 2) hot rolling, wherein a heating temperature is 1150° C.-1200° C., a finishing rolling temperature is 830-900° C., and coiling is performed at a temperature ≥570° C.; 3) flattening, being a cold rolling with a reduction ratio of 2-5%; 4) normalizing, wherein a temperature is not lower than 950° C. and a heat preservation time is 30-180 s; 5) acid pickling and cold rolling, wherein a cold rolling with cumulative rolling reduction ratio of 70-80% is performed after acid pickling; and 6) annealing, wherein a heating rate is 2100° C./s, heat preservation is performed at 800-1000° C. for 5-60 s, and then the steel is slowly cooled to 600-750° C. at 3-15° C./s.

SUMMARY

One objective of the present invention is to provide a non-oriented electrical steel sheet with low magnetic anisotropy, and the non-oriented electrical steel sheet is characterized by low iron loss and low magnetic anisotropy at high frequency.

In order to achieve the above objective, the present invention provides a non-oriented electrical steel sheet with low magnetic anisotropy, comprising the following chemical elements in mass percentage:

0<C≤0.005%; Si: 2.0-3.5%; Mn: 0.1-2.0%; at least one of Sn and Sb: 0.003-0.2%; Al: 0.2-1.8%; the balance being Fe and inevitable impurities.

In the non-oriented electrical steel sheet with low magnetic anisotropy according to the present invention, the design principles of each chemical element are described below:

C: in the non-oriented electrical steel sheet with low magnetic anisotropy according to the present invention, C strongly hinders the grain growth in a finished steel sheet, and tends to combine with Nb, V, Ti and the like to form fine precipitates, thereby causing increased loss and generating magnetic aging. Therefore, in the technical solution according to the present invention, the mass percentage of C is controlled to be 0<C≤0.005%.

Si: in the non-oriented electrical steel sheet with low magnetic anisotropy according to the present invention, Si improves resistivity of materials, and can effectively reduce iron loss of steel. When the mass percentage of Si is higher than 3.5%, magnetic induction of the steel will be markedly reduced; and when the mass percentage of Si is lower than 2.0%, it cannot effectively reduce the iron loss. Based on this, in the non-oriented electrical steel sheet with low magnetic anisotropy according to the present invention, the mass percentage of Si is controlled to be: Si: 2.0-3.5%.

Mn: in the technical solution according to the present invention, Mn combines with S to form MnS, which can reduce the harm to magnetic properties. When the mass percentage of Mn is lower than 0.1%, a sulfur retention effect will be poor; and when the mass percentage of Mn is higher than 2.0% or more, a recrystallization effect of the steel will be inhibited. Based on this, in the non-oriented electrical steel sheet with low magnetic anisotropy according to the present invention, the mass percentage of Mn is controlled to be: Mn: 0.1-2.0%.

At least one of Sn and Sb: in the non-oriented electrical steel sheet with low magnetic anisotropy according to the present invention, Sn and Sb can improve a crystal texture of the steel. Therefore, 0.003% or more of Sn and/or Sb are added into the steel. However, when more than 0.2% of Sn and/or Sb are added into the steel, it will cause abnormal grain refinement and deterioration of the iron loss of the steel. Based on this, in the non-oriented electrical steel sheet with low magnetic anisotropy according to the present invention, the mass percentage of Sn and Sb is controlled such that: at least one of Sn and Sb is 0.003-0.2%.

Al: in the non-oriented electrical steel sheet with low magnetic anisotropy according to the present invention, when the mass percentage of Al is lower than 0.2%, a good deoxidization effect cannot be achieved; and when the mass percentage of Al exceeds 1.8%, it will cause difficulty in continuous casting and degrade the workability of cold rolling. Based on this, in the non-oriented electrical steel sheet with low magnetic anisotropy according to the present invention, the mass percentage of Al is controlled to be: Al: 0.2-1.8%.

Preferably, the non-oriented electrical steel sheet with low magnetic anisotropy according to the present invention has an average grain size of 90-140 μm.

In the above embodiment, the average grain size is limited to be 90-140 μm. When the average grain size is lower than 90 μm, due to inclusions pinning the grain boundary and insufficient driving force for grain growth, magnetic hysteresis loss of the steel sheet is dominated and relatively high, resulting in high iron loss; meanwhile, due to the poor stability of grain orientation control, the magnetic anisotropy (L, C) of the steel sheet will exceed the desired level, that is, a ratio of a difference between an electromagnetic property parallel to a rolling direction and an electromagnetic property perpendicular to the rolling direction to a sum of the electromagnetic property parallel to the rolling direction and the electromagnetic property perpendicular to the rolling direction is large. In addition, when the average grain size is higher than 130 μm, a harmful {111} plane texture will rapidly grow to swallow the proportion of a favorable {100} plane texture, thereby causing the magnetic induction to deteriorate.

Preferably, in the non-oriented electrical steel sheet with low magnetic anisotropy according to the present invention, the inevitable impurities include: P≤0.2%, S≤0.003%, N≤0.002%, 0≤0.002%, and Ti≤0.0015%.

In the above embodiment, the inevitable impurities should be controlled to be less. P is controlled to be ≤0.2%, because when the mass percentage of P exceeds 0.2%, it is prone to causing cold brittleness, thereby reducing manufacturability of a cold rolling process. S is controlled to be ≤0.003%, because when the mass percentage of S exceeds 0.003%, the quantity of harmful inclusions of MnS and $Cu_2S$ will be greatly increased, thereby damaging a favorable texture of the steel and hindering the grain growth of a finished product. N is controlled to be ≤0.002%, because when the mass percentage of N exceeds 0.002%, the precipitates of N and Nb, V, Ti, Al, etc. will be greatly increased, thereby strongly hindering the grain growth and deteriorating magnetic properties of the steel. O is controlled to be ≤0.002%, because when the mass percentage of O exceeds 0.002%, the quantity of oxide inclusions will be greatly increased, which is not conducive to adjusting the proportion of inclusions and will deteriorate the magnetic properties of the steel. Ti is controlled to be ≤0.0015%, because when the mass percentage of Ti exceeds 0.0015%, precipitates of Ti and C and N will be greatly increased, thereby strongly hindering the grain growth and deteriorating the magnetic properties of the steel.

Preferably, the non-oriented electrical steel sheet with low magnetic anisotropy according to the present invention contains inclusions MnS and $Cu_2S$, and the inclusions have a size of 150-500 nm.

Preferably, in the non-oriented electrical steel sheet with low magnetic anisotropy according to the present invention, the inclusions have a shape of a sphere or a spheroid, and the inclusions have a plane projection of a circle or an ellipse.

In the above embodiment, by controlling the elements C, N, and Ti of the non-oriented electrical steel sheet of the present invention, during the cooling process of the continuous casting slab, coarse-sized MnS inclusions are preferentially precipitated, and the subsequent precipitation of low-melting, small-sized compounds (Ti, C, and N) can be avoided at the same time. Furthermore, under slow cooling conditions, the MnS inclusions are more prone to coarsening and growing, so that they eventually maintain a good shape of a sphere or a spheroid. As the spherical or spheroidal inclusions are not prone to forming more harmful wedge domains, they are easier to magnetize and the obtained non-oriented electrical steel sheet has excellent magnetic properties.

Preferably, in the non-oriented electrical steel sheet with low magnetic anisotropy according to the present invention, when the inclusions have a plane projection of an ellipse, the ellipse has a ratio of a long axis diameter to a short axis diameter of ≤4.0.

In the above embodiment, the MnS and $Cu_2S$ inclusions in the precipitates have a small difference in liquid phase external force, are not prone to deformation, and tend to form spherical or spheroidal inclusions, which have a plane projection of a circle or an ellipse, and the ellipse has a ratio of a long axis diameter to a short axis diameter of ≤4.0.

Preferably, in the non-oriented electrical steel sheet with low magnetic anisotropy according to the present invention, it has an iron loss $P_{10/400}$ of ≤11.0 W/kg, and a magnetic induction $B_{50}$ of ≥1.66 T. The term "magnetic anisotropy" of an electrical steel sheet refers to a ratio of a difference between an iron loss $P_{10/400\ L}$ parallel to the rolling direction and an iron loss $P_{10/400\ C}$ perpendicular to the rolling direction to a sum of the iron loss $P_{10/400\ L}$ parallel to the rolling direction and the iron loss $P_{10/400\ C}$ perpendicular to the rolling direction. Herein, the electrical steel sheet of the present invention has a magnetic anisotropy of ≤10%, which shows that the magnetic anisotropy of the electrical steel sheet is low. Herein, the measuring method of the electromagnetic properties is as follows: according to the Epstein square method (GB 10129-1988), the measurement is carried out with the Brockhaus magnetic measuring equipment (Germany). Herein, $P_{10/400}$ represents an iron loss value tested under a condition of 1.0 T and 400 Hz, and $B_{50}$ represents a magnetic induction value tested under a condition of 5000 A/m.

Accordingly, another objective of the present invention is to provide a manufacturing method for the above non-oriented electrical steel sheet with low magnetic anisotropy, and the non-oriented electrical steel sheet with low iron loss and small magnetic anisotropy at high frequency can be obtained through the manufacturing method.

In order to achieve the above objective, the present invention provides a manufacturing method of the above non-oriented electrical steel sheet with low magnetic anisotropy, which includes the following steps:

(1) smelting and casting;
(2) hot rolling;
(3) normalizing;
(4) cold rolling;
(5) continuous annealing: rapidly heating a cold-rolled steel sheet from an initial temperature of 350° C.-750° C. to a soaking temperature at a heating rate of 50-800° C./s, and performing soaking and heat preservation; and
(6) applying an insulating coating to obtain a finished non-oriented electrical steel sheet.

In the manufacturing method of the present invention, due to a large reduction ratio in cold rolling process as well as a high energy storage and many dislocations inside a cold-rolled steel sheet, it is conducive to the growth of harmful {111} plane texture and a favorable Goss texture and {110} surface texture with the relative small size are swallowed in the subsequent continuous annealing process. Therefore, cold rolled steel sheet is continuously annealed by: rapidly heating a cold-rolled steel sheet from an initial temperature of 350° C.-750° C. to a soaking temperature at a heating rate of 50-800° C./s, and performing soaking and heat preservation. This is because: through the continuous annealing process as described above, the crystal recovery can be effectively suppressed, and the residual deformation energy storage before recrystallization can be increased; thus, driving force for nucleation increases, and the strength of a <111>/ND recrystallization texture component decreases, which is conducive to the enhancement and improvement of electromagnetic properties. On the other hand, when the initial temperature of the continuous annealing is lower than 350° C., the residual deformation energy storage before the recrystallization is too high, formation of fine crystals and segregation are prone to occur subsequently, and it is necessary to increase the soaking temperature and soaking time of continuous annealing to achieve homogenization. However, when the initial temperature of the continuous annealing is higher than 750° C., the stability of grain orientation control will be poor and the proportion of favorable {100} plane texture will be greatly reduced, resulting in deterioration of magnetic induction. Herein, during rapid heating by electromagnetic induction, when the heating rate is lower than 50° C./s, the recrystallization process cannot be effectively controlled to form sufficient energy storage for subsequent control of grain orientation; and when the heating rate is higher than 800° C./s, the formation of fine crystals and unevenness of recrystallized structure are prone to occur, meanwhile, requirements for equipment functions will be higher, and equipment investment and operating cost will be increased.

Preferably, in the manufacturing method according to the present invention, step (1) includes a converter tapping process, ladle slag is subjected to modification treatment in the converter tapping process to satisfy: $(CaO)/(Al_2O_3) \geq 0.85$, and $T_{Fe} \geq 13\%$, wherein (CaO) and $(Al_2O_3)$ represent the content of CaO and $Al_2O_3$ in mass percentage, respectively; and $T_{Fe}$ represents the total content of the Fe element in mass percentage.

The above solution is mainly based on the following considerations: by increasing the content of $T_{Fe}$ in the slag, the reduction reaction of harmful element Ti in the slag and the steel can be effectively avoided; and by increasing the ratio of $(CaO)/(Al_2O_3)$, it is conducive to absorb harmful inclusions CaO and $Al_2O_3$ in the steel, thereby promoting the desulphurization reaction and inhibiting the precipitation of sulfide inclusions in continuous casting and hot rolling processes.

Preferably, in the manufacturing method according to the present invention, in step (4), the steel sheet is directly rolled to a finished product thickness of 0.10-0.30 mm by using a single cold rolling process.

Preferably, in the manufacturing method according to the present invention, in step (5), the heating rate is 100-600° C./s.

Compared with the prior art, the non-oriented electrical steel sheet with low magnetic anisotropy according to the present invention has the following advantages and beneficial effects: the non-oriented electrical steel sheet according to the present invention is characterized by low iron loss and low magnetic anisotropy at high frequency through the effective design of each component in the steel sheet.

In addition, the manufacturing method according to the present invention also has the above advantages and beneficial effects.

DETAILED DESCRIPTION

Figure 1:
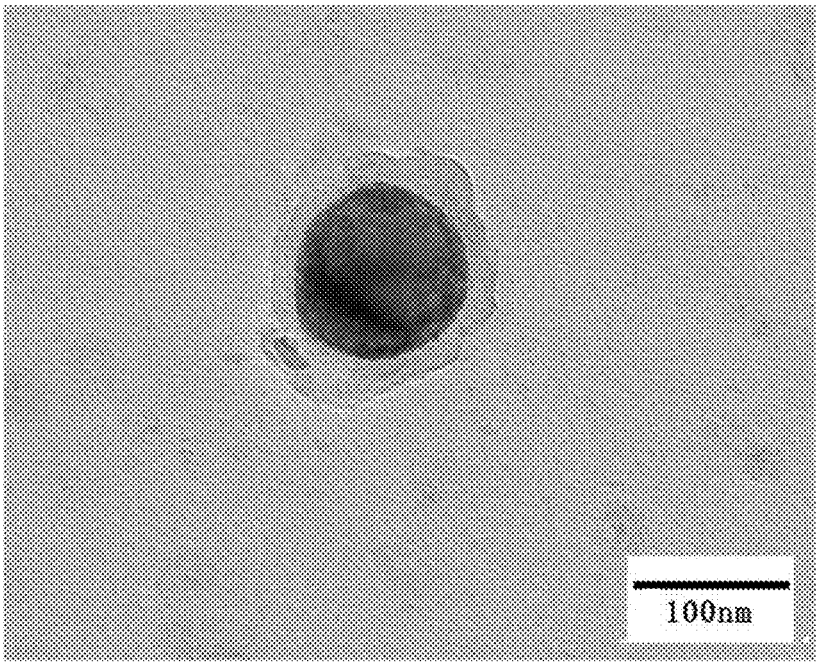
FIG. 1 shows the distribution of harmful inclusions in the conventional steel sheet of Comparative Example A4.

The non-oriented electrical steel sheet with low magnetic anisotropy and manufacturing method therefor according to the present invention are further explained and illustrated below with reference to the drawings of the specification and the specific embodiments, however, the technical solution of the present invention is not limited to the explanation and illustration.

Inventive Examples A9-A21 and Comparative Examples A1-A8

The non-oriented electrical steel sheets of Inventive Examples A9-A21 and the conventional steel sheets of Comparative Examples A1-A8 were manufactured by the following steps:

(1) The molten iron and steel scrap were prepared according to the composition as shown in table 1. After converter smelting, the ladle slag was modified, and subjected to decarburization and alloying in RH refining. The molten steel was continuously cast to obtain a continuous casting slab with a thickness of 120-250 mm and a width of 800-1400 mm.
(2) Hot rolling: The continuous casting slab was sequentially subjected to rough rolling and finish rolling to obtain a hot-rolled steel sheet. The hot-rolled steel sheet had a thickness of 1.5-2.8 mm.
(3) Normalizing: The hot-rolled steel sheet was normalized, wherein the soaking temperature was 800-1000° C. and the soaking time was 1-180 s during the normalization process.

(4) Cold rolling: The steel sheet was directly rolled to a thickness of 0.10-0.30 mm by using the single cold rolling process.

(5) Continuous annealing: The cold-rolled steel sheet was rapidly heated from an initial temperature of 350° C.-750° C. to a soaking temperature at a heating rate of 50-800° C./s, and soaking and heat preservation were conducted.

(6) An insulating coating was applied to obtain a finished non-oriented electrical steel sheet with a thickness of 0.10-0.30 mm.

It should be noted that in some preferable embodiments, the heating rate is 100-600° C./s.

In addition, in some preferable embodiments, the ladle slag was subjected to modification treatment in a converter tapping process to satisfy: $(CaO)/(Al_2O_3) \geq 0.85$ and $T_{Fe} \geq 13\%$, wherein (CaO) and $(Al_2O_3)$ represent contents of CaO and $Al_2O_3$ in mass percentage, respectively.

Table 1 lists the mass percentages of chemical elements of the non-oriented electrical steel sheets according to Inventive Examples A9-A21 and the conventional steel sheets according to Comparative Examples A1-A8.

Table 2 lists the specific process parameters of the non-oriented electrical steel sheets according to Inventive Examples A9-A21 and the conventional steel sheets according to Comparative Examples A1-A8.

TABLE 1

(wt %, the balance being Fe and other inevitable impurities other than P, S, N, O and Ti)

| No. | C | Si | Mn | P | S | A1 | O | N | Sn | Sb | Ti | Note |
|---|---|---|---|---|---|---|---|---|---|---|---|---|
| A1 | 0.0011 | 1.22 | 1.85 | 0.11 | 0.0021 | 0.83 | 0.0006 | 0.0011 | / | / | 0.0011 | Comparative example |
| A2 | 0.0021 | 1.85 | 2.52 | 0.06 | 0.0012 | 0.19 | 0.0011 | 0.0015 | 0 | 0.008 | 0.0017 | Comparative example |
| A3 | 0.0035 | 2.14 | 0.89 | 0.04 | 0.0009 | 1.16 | 0.0008 | 0.0029 | 0.11 | 0.04 | 0.0015 | Comparative example |
| A4 | 0.0028 | 2.29 | 0.25 | 0.18 | 0.0011 | 0.002 | 0.0019 | 0.0008 | 0.03 | 0.02 | 0.0008 | Comparative example |
| A5 | 0.0008 | 2.85 | 1.47 | 0.02 | 0.0005 | 1.89 | 0.0008 | 0.0017 | 0.001 | 0 | 0.0011 | Comparative example |
| A6 | 0.0044 | 3.15 | 0.58 | 0.13 | 0.0030 | 0.78 | 0.0017 | 0.0010 | 0.02 | 0.07 | 0.0014 | Comparative example |
| A7 | 0.0031 | 3.27 | 0.71 | 0.07 | 0.0008 | 2.25 | 0.0013 | 0.0012 | 0.04 | 0 | 0.0005 | Comparative example |
| A8 | 0.0016 | 3.62 | 0.16 | 0.03 | 0.0005 | 0.14 | 0.0008 | 0.0009 | 0 | 0.08 | 0.0025 | Comparative example |
| A9 | 0.0018 | 2.00 | 2.00 | 0.20 | 0.0030 | 0.20 | 0.0011 | 0.0014 | 0.008 | 0.003 | 0.0002 | Inventive Example |
| A10 | 0.0041 | 2.11 | 0.55 | 0.16 | 0.0021 | 1.80 | 0.0013 | 0.0007 | 0 | 0.005 | 0.0011 | Inventive Example |
| A11 | 0.0028 | 2.38 | 1.32 | 0.02 | 0.0026 | 0.93 | 0.0020 | 0.0006 | 0.008 | 0 | 0.0008 | Inventive Example |
| A12 | 0.0019 | 2.54 | 0.96 | 0.04 | 0.0022 | 0.92 | 0.0011 | 0.0008 | 0.002 | 0.011 | 0.0007 | Inventive Example |
| A13 | 0.0043 | 2.61 | 0.75 | 0.03 | 0.0011 | 0.55 | 0.0013 | 0.0016 | 0.005 | 0.005 | 0.0015 | Inventive Example |
| A14 | 0.0035 | 2.05 | 0.10 | 0.05 | 0.0015 | 1.27 | 0.0008 | 0.0020 | 0.15 | 0.05 | 0.0013 | Inventive Example |
| A15 | 0.0031 | 2.92 | 0.50 | 0.02 | 0.0008 | 0.82 | 0.0005 | 0.0008 | 0.02 | 0.09 | 0.0010 | Inventive Example |
| A16 | 0.0012 | 3.01 | 0.31 | 0.03 | 0.0008 | 0.42 | 0.0007 | 0.0005 | 0.04 | 0.02 | 0.0012 | Inventive Example |
| A17 | 0.0020 | 3.24 | 1.62 | 0.05 | 0.0016 | 0.81 | 0.0003 | 0.0013 | 0.05 | 0.12 | 0.0013 | Inventive Example |
| A18 | 0.0033 | 3.18 | 0.22 | 0.11 | 0.0002 | 0.60 | 0.0007 | 0.0007 | 0.07 | 0.01 | 0.0005 | Inventive Example |
| A19 | 0.0021 | 3.35 | 1.17 | 0.02 | 0.0008 | 0.22 | 0.0009 | 0.0011 | 0.05 | 0 | 0.0011 | Inventive Example |
| A20 | 0.0015 | 3.42 | 0.45 | 0.04 | 0.0011 | 0.45 | 0.0012 | 0.0014 | 0.03 | 0.08 | 0.0009 | Inventive Example |
| A21 | 0.0050 | 3.50 | 0.17 | 0.03 | 0.0015 | 1.00 | 0.0011 | 0.0006 | 0 | 0.003 | 0.0005 | Inventive Example |

TABLE 2

| No. | $(CaO)/(Al_2O_3)$ | $T_{Fe}$ [%] | Size of MnS and $Cu_2S$ [nm] | Ratio of long axis diameter/ short axis diameter of ellipse | Initial temp. for rapid heating [° C.] | Heating rate [° C./s] | Average grain size [μm] | Iron loss $P_{10/400}$ [W/kg] | Iron loss $P_{10/400\ L}$ [W/kg] | Iron loss $P_{10/400\ C}$ [W/kg] | Magnetic induction B50 [T] | Magnetic anisotropy [%] | Note |
|---|---|---|---|---|---|---|---|---|---|---|---|---|---|
| A1 | 0.21 | 13.8 | 95 | 2.5 | 20 | 600 | 78 | 12.7 | 5.64 | 7.06 | 1.64 | 11.2 | Comparative example |
| A2 | 0.89 | 15.9 | 83 | 3.7 | 650 | 400 | 82 | 11.4 | 4.97 | 6.43 | 1.62 | 12.8 | Comparative example |
| A3 | 1.27 | 3.1 | 154 | 2.9 | 450 | 300 | 82 | 11.8 | 5.26 | 6.54 | 1.63 | 10.8 | Comparative example |
| A4 | 2.23 | 16.8 | 231 | 4.8 | 800 | 900 | 69 | 12.5 | 5.51 | 6.99 | 1.63 | 11.8 | Comparative example |
| A5 | 1.88 | 5.2 | 317 | 2.8 | 20 | 15 | 72 | 12.2 | 5.46 | 6.74 | 1.65 | 10.5 | Comparative example |
| A6 | 0.43 | 18.4 | 65 | 5.2 | 500 | 100 | 53 | 13.0 | 5.80 | 7.20 | 1.65 | 10.7 | Comparative example |
| A7 | 0.21 | 20.5 | 38 | 1.7 | 350 | 400 | 71 | 12.2 | 5.23 | 6.97 | 1.63 | 14.3 | Comparative example |
| A8 | 1.57 | 17.1 | 417 | 1.3 | 200 | 200 | 82 | 11.7 | 5.25 | 6.45 | 1.64 | 10.2 | Comparative example |
| A9 | 0.87 | 16.5 | 163 | 3.5 | 350 | 200 | 118 | 11.0 | 5.05 | 5.95 | 1.68 | 8.2 | Inventive Example |
| A10 | 1.15 | 15.2 | 211 | 1.4 | 500 | 400 | 98 | 10.8 | 5.11 | 5.69 | 1.66 | 5.3 | Inventive Example |
| A11 | 1.32 | 16.8 | 418 | 3.2 | 700 | 800 | 121 | 10.6 | 4.81 | 5.79 | 1.70 | 9.2 | Inventive Example |
| A12 | 1.67 | 13.0 | 357 | 3.0 | 600 | 800 | 95 | 11.0 | 5.14 | 5.86 | 1.72 | 6.5 | Inventive Example |

TABLE 2-continued

| No. | (CaO)/($Al_2O_3$) | $T_{Fe}$ [%] | Size of MnS and $Cu_2S$ [nm] | Ratio of long axis diameter/ short axis diameter of ellipse | Initial temp. for rapid heating [° C.] | Heating rate [° C./s] | Average grain size [μm] | Iron loss $P_{10/400}$ [W/kg] | Iron loss $P_{10/400\ L}$ [W/kg] | Iron loss $P_{10/400\ C}$ [W/kg] | Magnetic induction B50 [T] | Magnetic anisotropy [%] | Note |
|---|---|---|---|---|---|---|---|---|---|---|---|---|---|
| A13 | 1.85 | 13.8 | 259 | 1.8 | 450 | 50 | 127 | 10.5 | 4.82 | 5.68 | 1.70 | 8.1 | Inventive Example |
| A14 | 1.93 | 14.5 | 183 | 1.4 | 750 | 200 | 137 | 10.3 | 4.97 | 5.33 | 1.69 | 3.5 | Inventive Example |
| A15 | 0.97 | 18.2 | 326 | 2.8 | 600 | 200 | 122 | 10.7 | 5.07 | 5.63 | 1.71 | 5.2 | Inventive Example |
| A16 | 1.41 | 19.1 | 453 | 1.2 | 650 | 300 | 130 | 10.4 | 4.83 | 5.57 | 1.71 | 7.1 | Inventive Example |
| A17 | 0.87 | 18.4 | 194 | 1.5 | 700 | 450 | 118 | 10.6 | 5.04 | 5.56 | 1.72 | 4.9 | Inventive Example |
| A18 | 1.04 | 16.5 | 288 | 2.0 | 350 | 550 | 125 | 10.5 | 5.05 | 5.45 | 1.70 | 3.8 | Inventive Example |
| A19 | 1.38 | 17.3 | 391 | 3.2 | 550 | 250 | 107 | 10.7 | 5.02 | 5.68 | 1.69 | 6.2 | Inventive Example |
| A20 | 1.57 | 14.0 | 357 | 2.4 | 400 | 100 | 101 | 10.3 | 4.92 | 5.38 | 1.68 | 4.4 | Inventive Example |
| A21 | 1.79 | 15.1 | 254 | 1.1 | 500 | 700 | 123 | 10.5 | 5.06 | 5.44 | 1.72 | 3.6 | Inventive Example |

As can be seen from Tables 1 and 2, the non-oriented electrical steel sheets according to the Inventive Examples contained inclusions mainly composed of MnS and $Cu_2S$, and the inclusions had a size of 150-500 nm. Furthermore, the inclusions had a shape of a sphere or a spheroid, and the inclusions had a plane projection of a circle or an ellipse. Furthermore, when the inclusions had a plane projection of an ellipse, the ellipse had a ratio of a long axis diameter to a short axis diameter of ≤4.0.

In addition, the non-oriented electrical steel sheets according to the Inventive Examples had an iron loss $P_{10/400}$ of ≤11.0 W/kg, a magnetic induction $B_{50}$ of ≥1.66 T, and a magnetic anisotropy (i.e., a ratio of a difference between an iron loss $P_{10/400\ L}$ parallel to a rolling direction and an iron loss $P_{10/400\ C}$ perpendicular to the rolling direction to a sum of the iron loss $P_{10/400\ L}$ parallel to the rolling direction and the iron loss $P_{10/400\ C}$ perpendicular to the rolling direction) of ≤10%.

In contrast, the conventional steel sheets according to the Comparative Examples did not achieve the technical effects brought by the Inventive Examples. That is, the conventional steel sheets according to the Comparative Examples exhibited poor control effect on magnetic induction and iron loss, and exhibited a large magnetic anisotropy. For example, for the conventional steel sheet in Comparative Example 1, the finished steel sheet had a high iron loss (12.7 W/kg), a low magnetic induction (1.64 T), and a magnetic anisotropy reaching 11.2%, owing to the facts that: the content of Si did not fall within the scope limited by the present invention, Sn and/or Sb were not added, and (CaO)/($Al_2O_3$) was only 0.21, which resulted in the size of corresponding inclusions MnS and $Cu_2S$ being only 95 nm; in addition, a continuous annealing process according to the present invention was not used.

Figure 2:
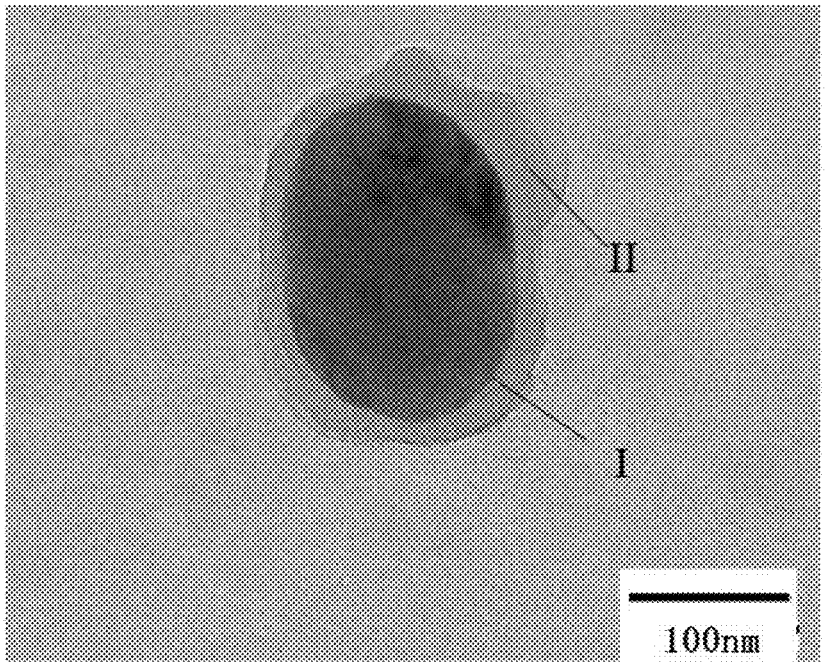
FIG. 2 shows the type and size distribution of harmful inclusions in the non-oriented electrical steel sheet with low magnetic anisotropy of Inventive Example A16.

FIG. 1 shows the distribution of harmful inclusions of the convention steel sheet of Comparative Example A4. FIG. 2 shows the type and size distribution situation of harmful inclusions of the non-oriented electrical steel sheet with low magnetic anisotropy of Inventive Example A16.

As can be seen from FIGS. 1 and 2, the size of MnS (position "I" as shown in FIG. 2) of the non-oriented electrical steel sheet of Inventive Example A16 was obviously greater than that of MnS of the conventional steel sheet of Comparative Example A4. The average size of peripheral $Cu_2S$ composite inclusions (position "II" as shown in FIG. 2) precipitated with MnS as the core was 300 nm. Compared with Comparative Example A4, the size of inclusions of Inventive Example A16 was 2-3 times larger, and therefore, the damage was greatly reduced.

Figure 3:
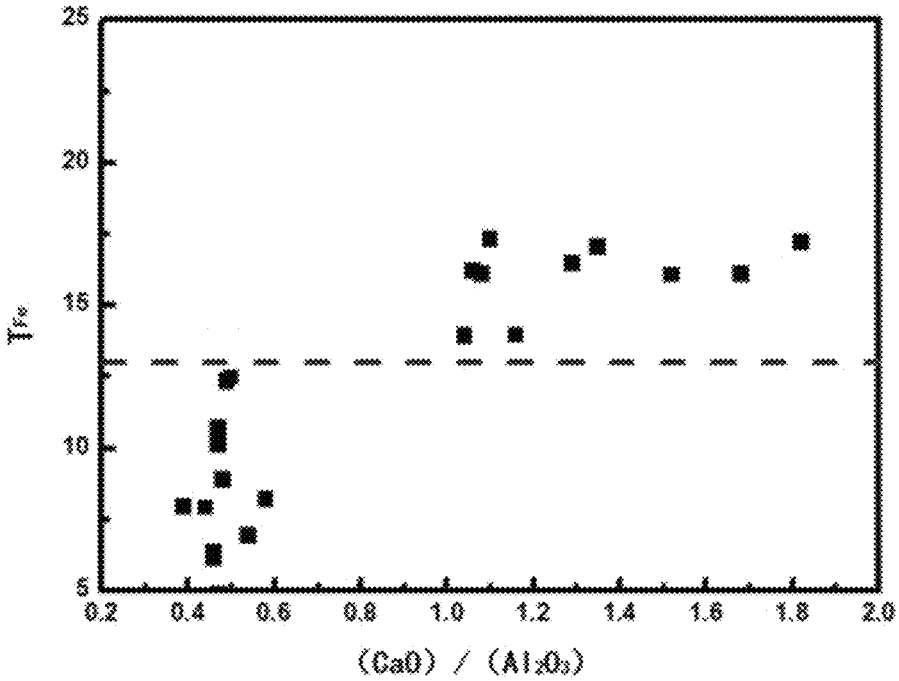
FIG. 3 schematically shows the relationship between different $(CaO)/(Al_2O_3)$ and TR.
Figure 4:
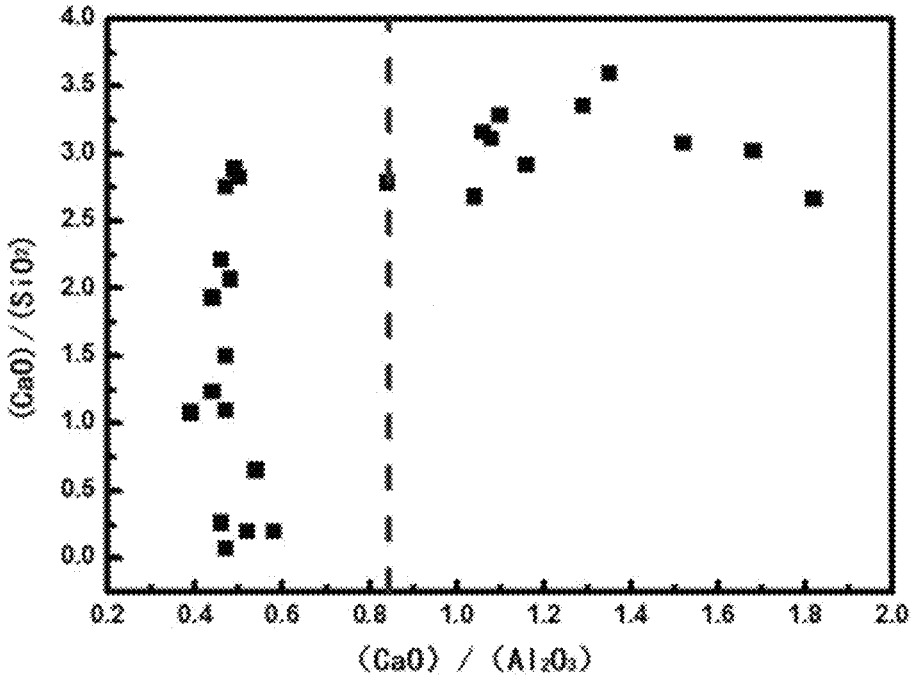
FIG. 4 schematically shows the relationship between different $(CaO)/(Al_2O_3)$ and $(CaO)/(SiO_2)$.

When the ladle slag was subjected to modification treatment, a better control effect can be achieved by controlling (CaO)/($Al_2O_3$)≥0.85 and $T_{Fe}$≥13%. FIGS. 3 and 4 respectively indicate the control effect on the ladle slag, wherein FIG. 3 schematically shows the relationship between different (CaO)/($Al_2O_3$) ratios and TR, and FIG. 4 schematically shows the relationship between different (CaO)/($Al_2O_3$) ratios and (CaO)/($SiO_2$).

As can be seen from FIGS. 3 and 4, by increasing the content of $T_{Fe}$ in the slag, the reduction reaction of harmful element Ti in the slag and the steel can be effectively avoided; and by increasing the (CaO)/($Al_2O_3$), it is conducive to absorb harmful inclusions such as CaO and $Al_2O_3$ in the steel, thereby promoting the desulphurization reaction and inhibiting the precipitation of sulfide inclusions in continuous casting and hot rolling processes.

Figure 5:
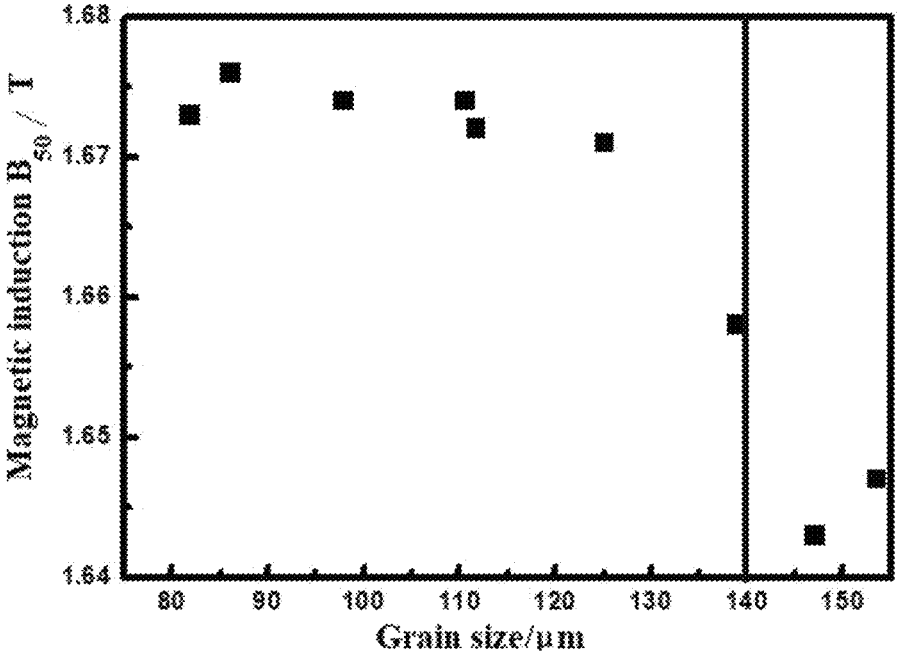
FIG. 5 schematically shows the relationship between different grain sizes and magnetic induction $B_{50}$.
Figure 6:
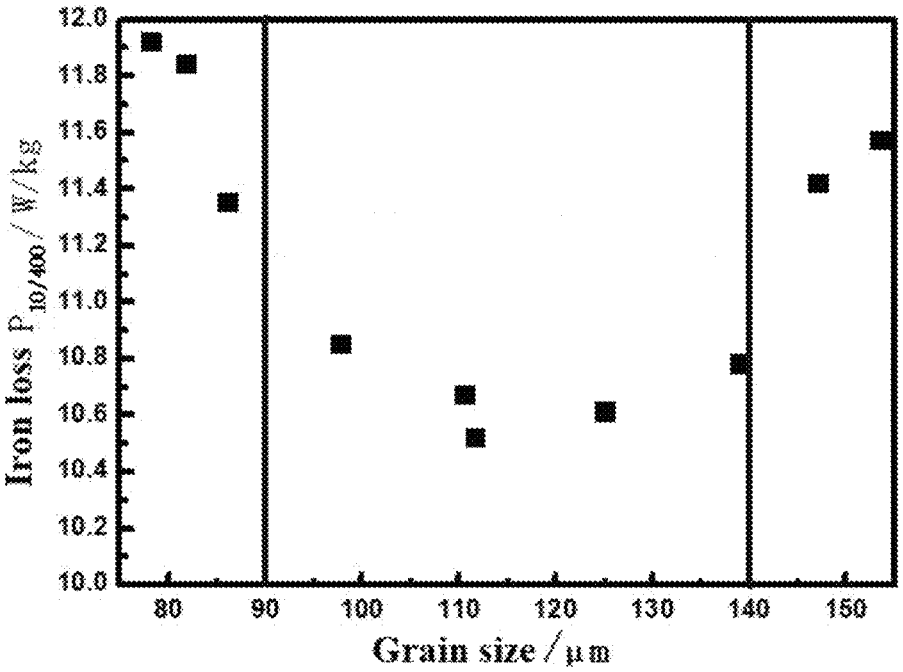
FIG. 6 schematically shows the relationship between different grain sizes and iron loss $P_{10/400}$.

FIG. 5 schematically shows the relationship between different grain sizes and magnetic induction $B_{50}$. FIG. 6 schematically shows the relationship between different grain sizes and iron loss $P_{10/400}$.

As can be seen from FIGS. 5 and 6, when the average grain size is in the range of 90-140 μm, the non-oriented electrical steel sheets of the present invention exhibited better magnetic properties, which had an iron loss $P_{10/400}$ of ≤11.0 W/kg and a magnetic induction $B_{50}$ of ≥1.66 T, this is because: when the average grain size is lower than 90 μm, due to inclusions pinning the grain boundary and insufficient driving force for grain growth, magnetic hysteresis loss of the steel sheet is dominated and relatively high, resulting in high iron loss; meanwhile, due to the poor stability of grain orientation control, the magnetic anisotropy (L, C) of the steel sheet will exceed the desired level, that is, a ratio of a difference between an iron loss $P_{10/400\ L}$ parallel to a rolling direction and an iron loss $P_{10/400\ C}$ perpendicular to the rolling direction to a sum of the iron loss $P_{10/400\ L}$ parallel to the rolling direction and the iron loss $P_{10/400\ C}$ perpendicular to the rolling direction is large. In addition, when the average grain size is higher than 130 μm, a harmful {111} plane texture will rapidly grow to swallow the proportion of a favorable {100} plane texture, thereby causing the magnetic induction to deteriorate.

In conclusion, it can be seen that the non-oriented electrical steel sheet with low magnetic anisotropy according to the present invention is characterized by low iron loss and low magnetic anisotropy at high frequency, through effective design of each component in the steel sheet.

In addition, the manufacturing method according to the present invention also has the above advantages and beneficial effects.

It should be noted that for the prior art part of protection scope of the present disclosure, it is not limited to the examples given in this application document. All the prior arts that do not contradict with the present disclosure, including but not limited to prior patent documents, prior publications, prior public use, etc., can be included in the protection scope of the present disclosure.

In addition, the combination of various technical features in the present disclosure is not limited to the combination described in the claims or the combination described in specific embodiments. All the technical features described in the present disclosure can be freely combined or combined in any way unless there is a contradiction between them.

It should also be noted that the above-listed Examples are only specific embodiments of the present disclosure. Apparently, the present disclosure is not limited to the above embodiments, and similar variations or modifications that are directly derived or easily conceived from the present disclosure by those skilled in the art should fall within the scope of the present disclosure.

The invention claimed is:

1. A non-oriented electrical steel sheet, comprising the following chemical elements in mass percentage:

$0<C\leq0.005\%$;

Si: 2.0-3.5%;

Mn: 0.1-2.0%;

Sn and/or Sb: 0.003-0.2% in total;

Al: 0.2-1.8%;

the balance being Fe and inevitable impurities;

wherein the inevitable impurities include: $P\leq0.2\%$, $S\leq0.003\%$, $N\leq0.002\%$, $O\leq0.002\%$, and $Ti\leq0.0015\%$, wherein the electrical steel sheet contains inclusions of MnS, wherein the inclusions have a size of 150-500 nm, and wherein the electrical steel sheet has an iron loss $P_{10/400}$ of ≤11.0 W/kg, a magnetic induction $B_{50}$ of ≥1.66 T, and a magnetic anisotropy, which is a ratio of a difference between an iron loss $P_{10/400}$ parallel to a rolling direction and an iron loss $P_{10/400}$ perpendicular to the rolling direction to a sum of the iron loss $P_{10/400}$ parallel to the rolling direction and the iron loss $P_{10/400}$ perpendicular to the rolling direction, of ≤10%.

2. The non-oriented electrical steel sheet as claimed in claim 1, characterized in that the electrical steel sheet has an average grain size of 90-140 μm.

3. The non-oriented electrical steel sheet as claimed in claim 1, characterized in that the inclusions have a shape of a sphere or a spheroid, and the inclusions have a plane projection of a circle or an ellipse.

4. The non-oriented electrical steel sheet as claimed in claim 3, characterized in that the inclusions have a plane projection of an ellipse, and the ellipse has a ratio of a long axis diameter to a short axis diameter of ≤4.0.

5. A manufacturing method for the non-oriented electrical steel sheet as claimed in claim 1, comprising the following steps:

(1) smelting and casting;

(2) hot rolling;

(3) normalizing;

(4) cold rolling;

(5) continuous annealing: rapidly heating a cold-rolled steel sheet from an initial temperature of 350° C.-750° C. to a soaking temperature at a heating rate of 50-800° C./s, and performing soaking and heat preservation; and (6) applying an insulating coating to obtain a finished non-oriented electrical steel sheet;

wherein step (1) includes a converter tapping process, ladle slag is subjected to modification treatment in the converter tapping process to satisfy: $(CaO)/(Al_2O_3)\geq0.85$, and $T_{Fe}\geq13\%$, wherein (CaO) and $(Al_2O_3)$ represent contents of CaO and $Al_2O_3$ in mass percentage, respectively, and $T_{Fe}$ represents the total content of the Fe element in mass percentage.

6. The manufacturing method as claimed in claim 5, characterized in that in step (4), the steel sheet is directly rolled to a finished product thickness of 0.10-0.30 mm by using a single cold rolling process.

7. The manufacturing method as claimed in claim 5, characterized in that in step (5), the heating rate is 100-600° C./s.

* * * * *